US007046216B2

(12) United States Patent
Lim et al.

(10) Patent No.: US 7,046,216 B2
(45) Date of Patent: May 16, 2006

(54) METHOD FOR DRIVING PLASMA DISPLAY PANEL

(75) Inventors: Geun Soo Lim, Kyonggi-do (KR); Jeong Pil Choi, Kyonggi-do (KR); Tae Hyung Kim, Seoul (KR); Dai Hyun Kim, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 10/191,347

(22) Filed: Jul. 8, 2002

(65) Prior Publication Data

US 2003/0006945 A1 Jan. 9, 2003

(30) Foreign Application Priority Data

Jul. 9, 2001 (KR) ..... P2001-0040803

(51) Int. Cl.
*G09G 3/10* (2006.01)

(52) U.S. Cl. ..... 345/37; 41/60

(58) Field of Classification Search ..... 345/37, 345/41, 42, 60–72; 315/169.1, 169.4
See application file for complete search history.

(56) References Cited

U.S. PATENT DOCUMENTS

| | | | | |
|---|---|---|---|---|
| 4,104,626 | A * | 8/1978 | Ngo | 345/61 |
| 5,745,086 | A * | 4/1998 | Weber | 345/63 |
| 6,249,087 | B1 * | 6/2001 | Takayama et al. | 315/169.1 |
| 6,294,875 | B1 * | 9/2001 | Kurata et al. | 315/169.1 |

* cited by examiner

*Primary Examiner*—Sumati Lefkowitz
*Assistant Examiner*—Srilakshmi K Kumar
(74) *Attorney, Agent, or Firm*—Lee, Hong, Degerman, Kang & Schmadeka

(57) ABSTRACT

A plasma display panel that minimizes the power consumption required for driving the PDP is disclosed. A reset pulse of a ramp-down waveform supplied in a reset period goes down to a voltage level higher than a negative scan reference voltage, and is kept for a specified period. Also, a sustain pulse voltage level of a selective erase type sub-field is provided with a voltage level relatively higher than the sustain pulse provided from the selective write type sub-field, or a reset pulse of a ramp-up waveform that goes from a maximum voltage level of the ramp-up waveform down to a ground voltage level or more is supplied to a scan electrode as well as a selective erase scan pulse descends from a predetermined selective erase scan voltage level to the ground level or more. Therefore, the data driving voltage is minimized, and the display state is stabilized.

22 Claims, 12 Drawing Sheets

METHOD FOR DRIVING PLASMA DISPLAY PANEL

This application claims the benefit of the Korean Application No. P2001-40803 filed on Jul. 9, 2001, which is hereby incorporated by reference.

BACKGROUND OF THE INVENTION

1. Field of the Invention

The present invention relates to a plasma display panel, and more particularly, to a method of driving a plasma display panel that can minimize the power consumption required for driving the plasma display panel.

2. Discussion of the Related Art

A plasma display panel (hereinafter referred to as PDP) is a device that displays pictures including texts or graphics by effecting luminescence of phosphors by ultraviolet (UV) rays generated during the discharge of an inert mixed gas (for instance, He+Xe or Ne+Xe).

Such a PDP has the advantage that it can be easily formed into a thin film and large-sized, and recently, with the technical development, it can provide a greatly improved picture quality.

A typical PDP, as shown in FIG. 1, has three electrodes, and is driven by an AC voltage. This is called an AC surface discharge type PDP.

In this AC surface discharge type PDP having three electrodes, wall charge is accumulated on its surface during the discharging operation, and the electrodes are protected from sputtering generated due to the discharging operation. Thus, it has the advantages of a low-voltage drive and a long lifetime.

FIG. 1 is a perspective view of a discharge cell structure of a conventional AC surface discharge type PDP having three electrodes.

Referring to FIG. 1, the discharge cell of the three-electrode AC surface discharge type PDP is provided with a scan electrode 12Y and a sustain electrode 12Z formed on a front substrate 10, and an address electrode 20X formed on a back substrate 18.

On the front substrate 10 where the scan electrode 12Y and the sustain electrode 12Z are formed in lines are laminated a front dielectric layer 14 and a protective layer 16. On the front dielectric layer 14 is accumulated the wall charge generated during the plasma discharge.

The protective layer 16 prevents the damage of the front dielectric layer 14 due to the sputtering generated during the plasma discharge, and heightens the emission efficiency of secondary electrons. As the protective layer 16 is typically used a magnesium oxide (MgO).

On the back substrate 18 where the address electrode 20Z is formed are formed a back dielectric layer 22 and a barrier rib 24. On surfaces of the back dielectric layer and the barrier rib 24 is formed phosphors 26.

The address electrode 20X is formed in an intersectional direction of the scan electrode 12Y and the sustain electrode 12Z.

The barrier rib 24 is formed in lines with the address electrode 20X, and prevents the leakage of the ultraviolet rays and visible rays generated by the discharge to an adjacent discharge cell.

The phosphors 26 are excited by the ultraviolet rays generated during the plasma discharge to generate one among visible rays of red, green, and blue. In a discharge space provided among the two substrates 10 and 18 and the barrier rib 24 is injected an inert gas for gas discharge.

The discharge cells as described above are arranged in the form of a matrix as shown in FIG. 2.

As shown in FIG. 2, in one discharge cell 1, scan electrode lines Y1 to Ym and sustain electrode lines Z1 to Zm are arrange in parallel, and discharge cells are provided at the intersection portions of the two parallel electrode lines Y1 to Ym, and Z1 to Zm and the address electrode lines X1 to Xn, respectively.

The scan electrode lines Y1 to Ym are sequentially driven, and the sustain electrode lines Z1 to Zm are commonly driven. The address electrode lines X1 to Xn are driven, being divided into odd lines and even lines.

In this AC surface discharge type PDP having three electrodes, a driving time for representing a specified gray scale with respect to a frame is separated into a plurality of sub-fields. For a sub-field duration, the luminescence is performed with its frequency proportioned to a weight of the video data to perform the representation of the gray scale.

FIG. 3 is a view illustrating an example of a frame structure according to the driving of the conventional PDP.

Referring to FIG. 3, one frame according to the driving of the AC surface discharge type PDP having three electrodes is divided into 12 sub-fields SF1 to SF12 in time. Specifically, one frame duration in the respective discharge cell 1 is divided into selective write type sub-fields SF1 to SF6 and selective erase type sub-fields SF7 to SF12.

The selective write type sub-fields represent a low gray scale by maintaining the discharge of the discharge cells selected and turned on, and the selective erase type sub-fields represent a high gray scale by turning off the cells which were turned on in the last selective write type sub-field among the selective write type sub-fields.

The first sub-field SF1 is divided into a reset period for initializing the whole picture, a selective write address period for turning on the selected discharge cells, a sustain period for keeping the sustain discharge of the discharge cells selected by an address discharge, and an erase period for erasing the sustain discharge.

The second to fifth sub-fields SF2 to SF5 are each divided into a selective write address period, a sustain period, and an erase period.

Also, the sixth sub-field SF6 is divided into a selective write address period and a sustain period.

Specifically, in the first to sixth sub-fields SF1 to SF6, the selective write address period and the erase period are determined in the same ratio. On the contrary, the sustain period is given in the ratio of 2N (where, N=0, 1, 2, 3, . . . , 7) with different time weights in the respective sub-fields SF1 to SF6. That is, the sustain period is increasingly given in the ratio of 1:2:4:8:16:32:64:128 in the first to eighth sub-fields SF1 to SF8.

The next seventh to twelfth sub-fields SF7 to SF12 are each divided into a selective erase address period for turning off the selected discharge cells without a period for writing the whole picture, and a sustain period for effecting the sustain discharge of the discharge cells except for the discharge cells selected by the address discharge.

In the seventh to twelfth sub-fields SF7 to SF12, the selective erase address period and the sustain period are determined in the same ratio.

Especially, the sustain period of the seventh to twelfth sub-fields SF7 to SF12 is determined to having the same luminance relative ratio as the sixth sub-field SF6.

The seventh to twelfth sub-fields SF7 to SF12 are driven by the selective erasing method, and thus the previous sub-field should be necessarily in a turned-on state so as to be able to turn off the unnecessary discharge cells whenever the respective sub-fields continue.

For example, in order for the seventh sub-field SF7 to be turned on, the sixth sub-field SF6 that is driven by the selective erasing method should be turned on.

After the sixth sub-field SF6 is turned on as above, the seventh to twelfth sub-fields SF7 to SF12 turn off the unnecessary discharge cells.

In order to utilize the selective erase sub-fields (ESF) SF7 to SF12 of the selective erasing type, the discharge cells which were turned on at the sixth sub-field SF6 that is the last selective write sub-field (WSF) should be kept in a turned-on state by the sustain discharge.

Accordingly, the seventh sub-field SF7 does not need a separate writing discharge for the selective erase addressing. Also, the eighth to twelfth sub-fields SF8 to SF12 selectively turn off the cells of the turned-on state at the previous sub-field without writing of the whole picture.

FIG. 4 is a waveform diagram illustrating an example of driving waveforms according to the PDP driving in the frame of FIG. 3.

Referring to FIG. 4, for a reset period of a first selective write sub-field SW1, a reset pulse RP of a ramp-up waveform is supplied to the scan electrode lines Y in a set-up period, and then a reset pulse −RP of a ramp-down waveform is supplied to the scan electrode lines Y in a set-down period.

The reset pulse −RP of the ramp-down waveform descends to a negative (−) scan reference voltage −Vw. At the time point when the reset pulse −RP of the ramp-down waveform is supplied, a positive (+) scan DC voltage DCSC starts to be supplied to the sustain electrode lines Z.

For the address period of the first selective write sub-field SW1, a negative (−) selective write scan pulse −SWSP is supplied to the scan electrode lines Y while the positive (+) scan DC voltage DCSC is supplied to the sustain electrode lines Z, and a positive (+) selective write data pulse SWDP that is synchronized with the negative (−) selective write scan pulse −SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the first selective write sub-field SW1.

Also, at the end time point of a second selective write sub-field SW2, an erase pulse EP for erasing the sustain discharge is supplied to the scan electrode lines Y.

The reset period of the next selective erase sub-fields SE1,SE2, . . . is omitted as described above, and the address period starts directly.

For the address period of the selective erase sub-fields SE1,SE2, . . . , selective erase pulses SESP and SEDP for turning off the discharge cells are supplied to the scan electrode lines Y and the address electrode lines X, respectively. In more detail, a negative (−) selective erase scan pulse −SESP is supplied to the scan electrode lines Y, and a positive (+) selective data pulse SEDP that is synchronized with the negative selective erase scan pulse −SESP is supplied to the address electrode lines X. Here, the selective erase scan pulse −SESP is supplied with a selective erase scan voltage level −Ve that is higher than the scan reference voltage −Vw.

For the sustain period of the selective erase sub-fields SE1,SE2, . . . , the sustain pulses SUSPy and SUSPz are alternately supplied to the scan electrode lines Y and the sustain electrode lines Z so that the sustain discharge is produced with respect to the discharge cells which are not turned off by the address discharge.

In case that the following sub-field is the selective erase field SE, the sustain pulse SUSPy having a relatively large pulse width is supplied to the scan electrode lines Y at the end time point of the present selective erase sub-field SE.

In the last selective erase sub-field, an erase pulse EP and a ramp pulse are supplied to the scan electrode lines Y and the sustain electrode lines Z. Accordingly, the sustain discharge of the discharge cells of the turned-off state is erased. At this time, the next sub-field of the last selective erase sub-field will be the selective write sub-field SW.

FIGS. 5A to 5C are views illustrating the wall charge formed in a reset period of a selective write sub-field of FIG. 4, and especially the wall charge generated by a ramp pulse applied in a reset period of the first sub-field SF1 in FIG. 4.

The wall charge illustrated in FIG. 5A is caused by the ramp-up waveform (RP; A) applied in the reset period. If the reset pulse of the ramp-up waveform (RP; A) is applied in the reset period of the first sub-field SF1, the wall charge is accumulated over a specified amount on the scan electrode Y and the sustain electrode Z of the whole panel.

The wall charge illustrated in FIG. 5B is caused by the ramp-down waveform (−RP; B) applied in the reset period. If the reset pulse of the ramp-down waveform (−RP; B) is applied in the reset period of the first sub-field SF1, the wall charge accumulated on the scan electrode Y and the sustain electrode Z is removed to some extent.

Thereafter, if the reset period of the first sub-field SF1 ends, the ramp-down waveform (−RP; B) becomes the scan reference voltage −Vw, and the wall charge will be as shown in FIG. 5C.

As shown in FIGS. 5A to 5C, since in the reset period of the first sub-field SF1, the wall charge is accumulated on the address electrode X as well as on the scan electrode Y and the sustain electrode Z, the address electrode X can be driven by a voltage that is lower than the voltage level of the data pulse applied to the address electrode X as much as the wall charge in the first sub-field SF1.

However, after the second sub-field SF2, the driving conditions of the sub-fields are different.

That is, in the second sub-field SF2, there are the discharge cells of the turned-on state and the discharge cells of the turned-off state in the previous sub-field, and when the conditions of the wall charge accumulated on the respective electrodes in the two kinds of discharge cells separated before the address period of the sub-field become the same, the driving of a new sub-field starts again.

Accordingly, a method is used for lowering the positive (+) wall charge accumulated on the address electrode X of the discharge cells of the turned-off state to the voltage level of the wall charge of the discharge cells of the turned-on state. This is achieved using the reset pulse of the ramp-down waveform that descends to the negative (−) voltage level.

In other words, the general driving of the PDP has been performed using the ramp waveform for each sub-field. That is, the whole panel is initialized using the reset pulse of the high ramp waveform irrespective of the discharge cells of the turned-on state and the discharge cells of the turned-off state after the sustain discharge.

However, according to the driving method according to the driving waveform of FIG. 4, a high contrast characteristic is obtained by using the driving method that matches the conditions of the discharge cells of the turned-on state and the discharge cells of the turned-off state without using the reset pulse of the ramp waveform that deteriorates the contrast characteristic.

According to this driving method, however, since the voltage level of the data pulse is lowered as much as the wall charge only in the first sub-field SF1, the voltage level of the positive (+) wall charge accumulated on the address electrode X is lowered after the second sub-field SF2, and this causes the data driving voltage (voltage level of the data pulse) to be heightened.

FIG. 6 is a waveform diagram illustrating another example of driving waveforms according to the PDP driving in the frame of FIG. 3.

Referring to FIG. 6, all the sub-fields SW1 to SW12 of one frame are selective write sub-fields.

For a reset period of a selective write sub-field SW, a reset pulse RP of a ramp-up waveform is supplied to the scan electrode lines Y in a set-up period, and then a reset pulse −RP of a ramp-down waveform is supplied to the scan electrode lines Y in a set-down period.

At this time, the reset pulse −RP of the ramp-down waveform descends to a negative (−) scan reference voltage −Vw. At the time point when the reset pulse −RP of the ramp-down waveform is supplied, a positive (+) scan DC voltage DCSC starts to be supplied to the sustain electrode lines Z. This is for reducing the wall charge formed on the respective electrodes.

For the address period of the selective write sub-field SW1, a negative (−) selective write scan pulse −SWSP is supplied to the scan electrode lines Y while the positive (+) scan DC voltage DCSC is supplied to the sustain electrode lines Z, and a positive (+) selective write data pulse SWDP that is synchronized with the negative (−) selective write scan pulse −SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the selective write sub-field SW.

Also, at the end time point of the selective write sub-field SW, an erase pulse EP for erasing the sustain discharge is supplied to the scan electrode lines Y.

In the PDP driving according to FIG. 6, the PDP driving becomes stable as the number of reset pulses of the ramp waveform becomes larger. However, it has the drawback in that it deteriorates the contrast characteristic.

Also, in the conventional PDP driving according to FIG. 6, since the reset pulse −RP of the ramp-down waveform descends to the negative (−) scan reference voltage −Vw, the positive (+) selective write data pulse SWDP applied in synchronization with the negative (−) selective write scan pulse −SWSP in the address period should be kept in a high voltage level. In other words, it has the drawback in that the data driving voltage (i.e., voltage level of the data pulse) becomes heightened.

SUMMARY OF THE INVENTION

Accordingly, the present invention is directed to a method of driving a PDP that substantially obviates one or more problems due to limitations and disadvantages of the related art.

An object of the present invention is to provide a method of driving a PDP that is suitable for minimizing a data driving voltage (i.e., voltage level of a data pulse) supplied to address electrode lines X.

Another object of the present invention is to provide a method of driving a PDP that is suitable for minimizing a data driving voltage (i.e., voltage level of a data pulse) by applying a reset pulse of a ramp waveform in a reset period of all sub-fields of a selective write type in a PDP driving system whereby a frame period in the respective discharge cells is divided into selective write type sub-fields and selective erase type sub-fields.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a three-electrode plasma display panel (PDP) driving method for displaying a frame including a plurality of sub-fields, the method includes a first step of generating a reset discharge by supplying ramp waves for making cells of the PDP in a uniform state in a reset period of selective write type sub-fields, a second step of generating an address discharge by supplying a selective write scan pulse (SWSP) that swings round a maximum supply voltage level of the reset discharge and a selective write data pulse (SWDP) that is synchronized with the selective write scan pulse during an address period following the reset period, and a third step of keeping the generated address discharge by supplying a sustain pulse during a sustain period following the address period.

Preferably, at the first step, a reset pulse of a ramp-up waveform that is added up is supplied to a scan electrode, and then to the scan electrode is supplied a reset pulse of a ramp-down waveform that maintains a minimum supply voltage level for a specified period after the reset pulse of the ramp-up waveform goes from its maximum voltage level down to the minimum supply voltage level that is relatively higher than a predetermined negative (−) scan reference voltage.

Especially, the reset pulse of the ramp-up waveform is added up to 30V at maximum, and the reset pulse of the ramp-down waveform goes down to the voltage level that is 15~20V higher than the negative scan reference voltage determined as −80V.

Also, preferably, at a time point when the reset pulse of the ramp-down waveform is supplied, a positive (+) first scan DC voltage for reducing wall charge previously formed is supplied to a sustain electrode, and in the address period, a second scan DC voltage that is relatively lower than the first scan DC voltage is supplied to the sustain voltage.

Preferably, the method further includes a fourth step of generating an address discharge for turning off the discharge cells which were turned on in the selective write type sub-fields by supplying a selective erase scan pulse (SESP) to the scan electrode and supplying a positive (+) selective erase data pulse (SEDP) that is synchronized with the selective erase scan pulse (SESP) to an address electrode in the address period of the selective erase type sub-fields after the third step, and a fifth step of generating a sustain discharge for the discharge cells which were not turned off by the address discharge by supplying the sustain pulse in the sustain period following the address period of the selective erase type sub-fields after the fourth step.

Especially, the voltage level of the sustain pulse of the selective erase type sub-field is relatively higher than that of the sustain pulse provided from the selective write type sub-field.

In another aspect of the present invention, a three-electrode plasma display panel (PDP) driving method for displaying a frame including at least one selective write type sub-field that represents a low gray scale by turning on selected discharge cells and keeping discharge of the discharge cells, and at least one selective erase type sub-field that represents a high gray scale by turning off the cells turned on in the last sub-field among the selective write type sub-fields, the method includes a first step of generating a reset discharge by supplying positive ramp waves for making the cells of the PDP in a uniform state in a reset period of selective write type sub-fields, a second step of generating an address discharge by supplying a selective write scan pulse (SWSP) that swings over a ground voltage level and a positive selective write data pulse (SWDP) that is synchronized with the selective write scan pulse during an address period following the reset period, and a third step of keeping the generated address discharge by supplying a sustain pulse during a sustain period following the address period.

Preferably, at the first step, a reset pulse of a ramp-up waveform that is added up is supplied to a scan electrode, and then to the scan electrode is supplied a reset pulse of a ramp-down waveform that goes from a maximum voltage level of the ramp-up waveform down to the ground voltage level or more.

Especially, from a time point when the reset pulse of the ramp-down waveform is supplied to the address period, a positive (+) scan DC voltage for reducing wall charge previously formed is supplied to a sustain electrode.

Preferably, the method further includes a fourth step of generating an address discharge for turning off the discharge cells which were turned on in the selective write type sub-fields by supplying a selective erase scan pulse (SESP) to the scan electrode and supplying a positive (+) selective erase data pulse (SEDP) that is synchronized with the selective erase scan pulse (SESP) to an address electrode in the address period of the selective erase type sub-fields after the third step, and a fifth step of generating a sustain discharge for the discharge cells which were not turned off by the address discharge by alternately supplying the sustain pulses to the scan electrode and a sustain electrode in the sustain period following the address period of the selective erase type sub-fields.

Especially, the selective erase scan pulse (SESP) descends from a predetermined selective erase scan voltage level to the ground level or more.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, the PDP driving method according to the preferred embodiments of the present invention will be explained with reference to FIGS. 7 to 12.

Figure 1:
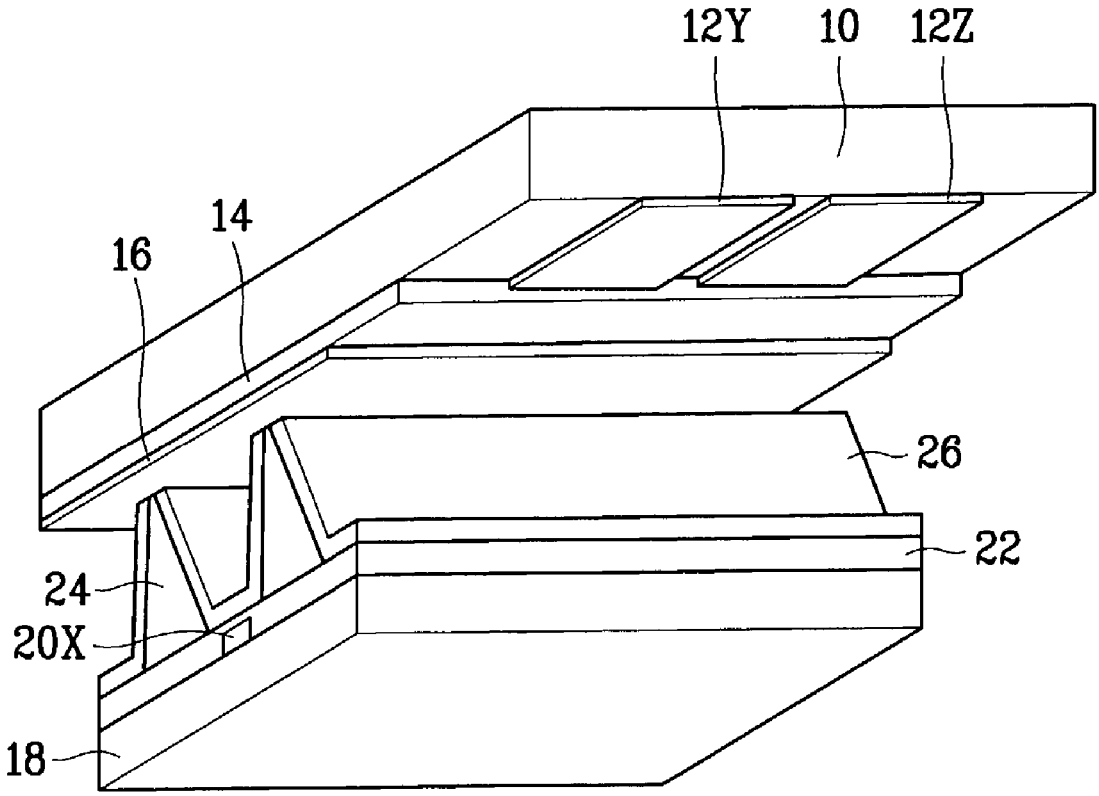
FIG.1 Related Art
FIG. 1 is a perspective view of a discharge cell structure of a conventional AC surface discharge type PDP having three electrodes.
Figure 2:
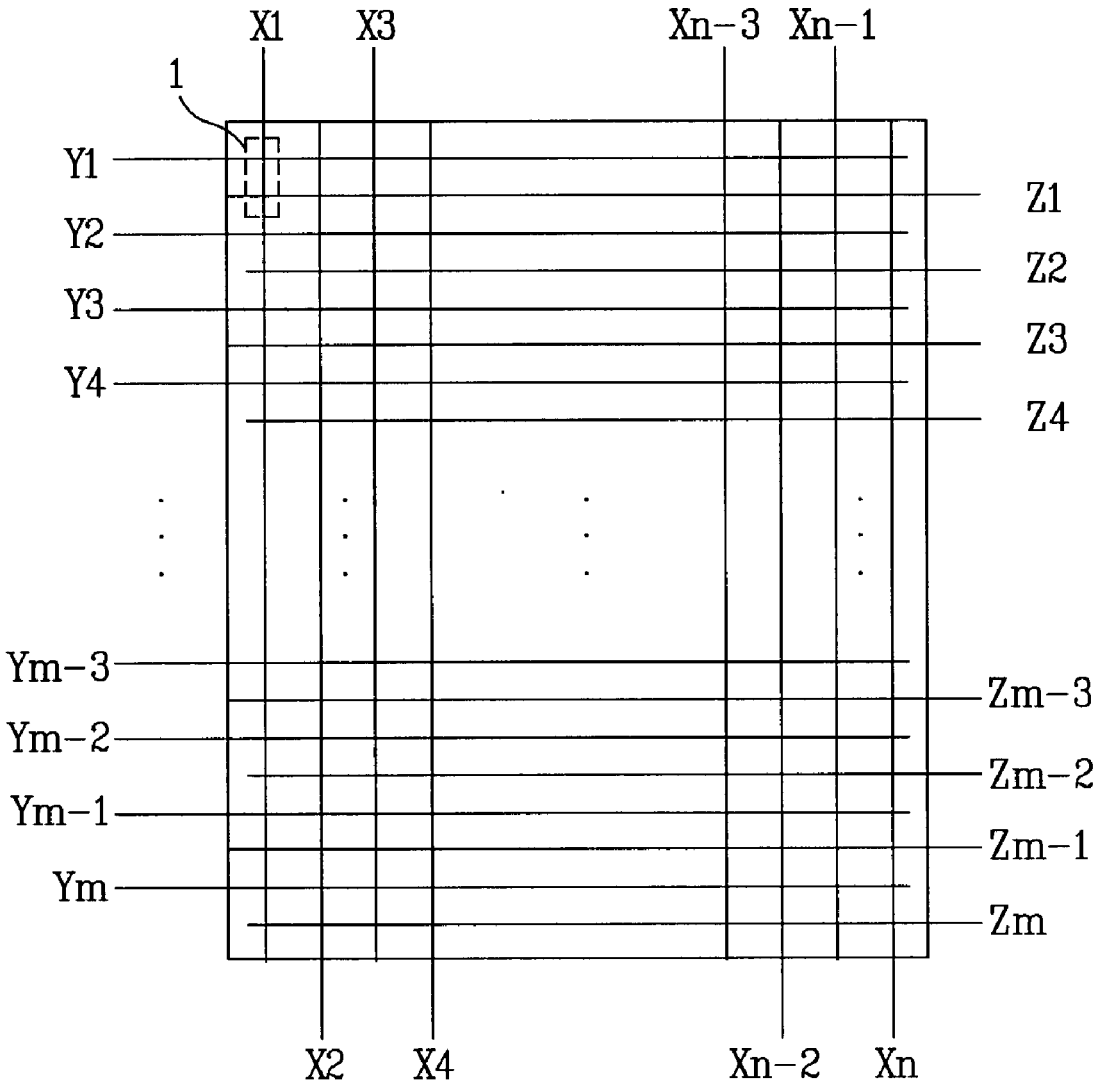
FIG.2 Related Art
FIG. 2 is a view illustrating discharge cells of the PDP arranged in the form of a matrix.
Figure 3:
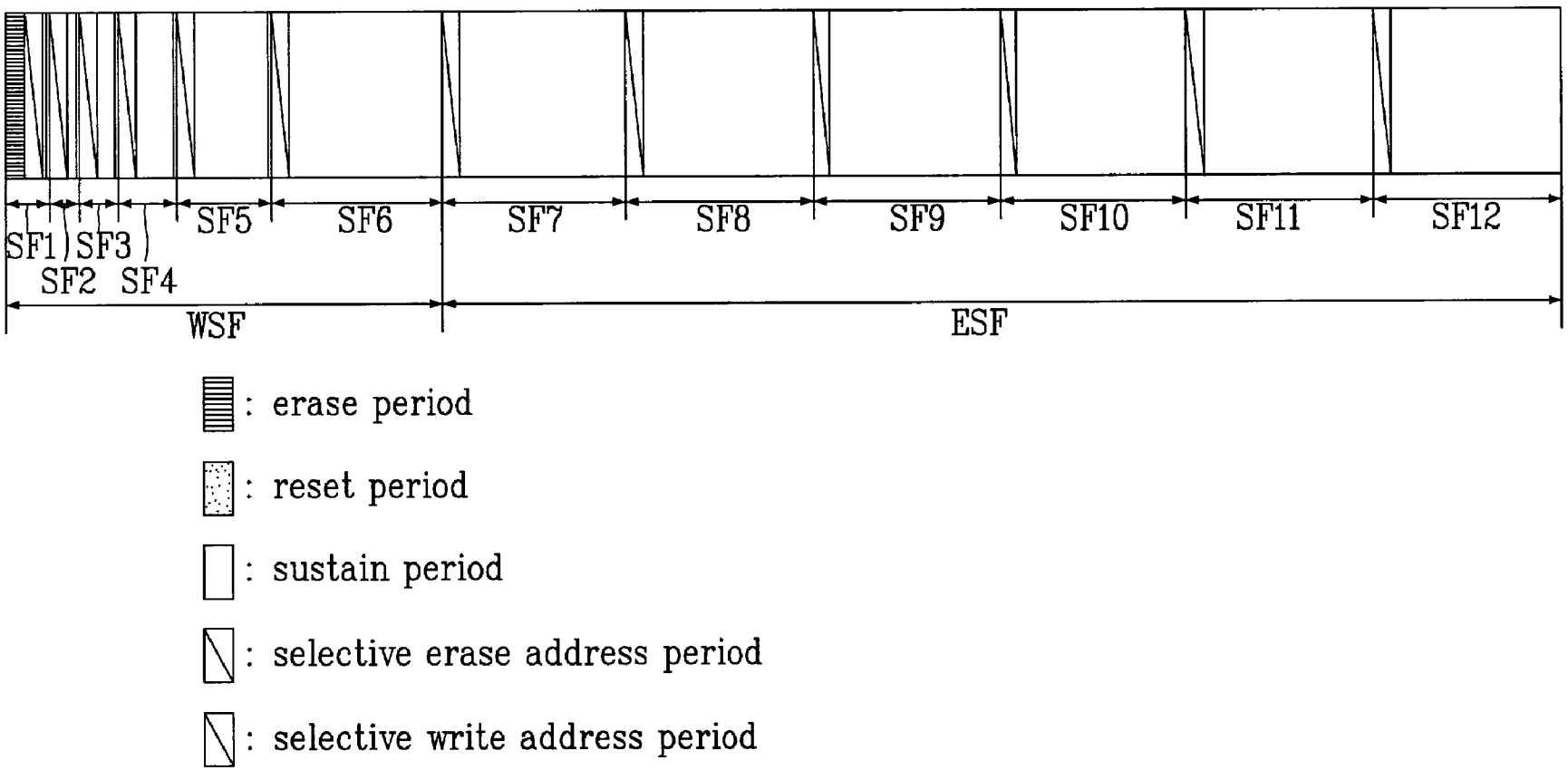
FIG.3 Related Art
FIG. 3 is a view illustrating an example of a frame structure according to the conventional PDP driving.
Figure 4:
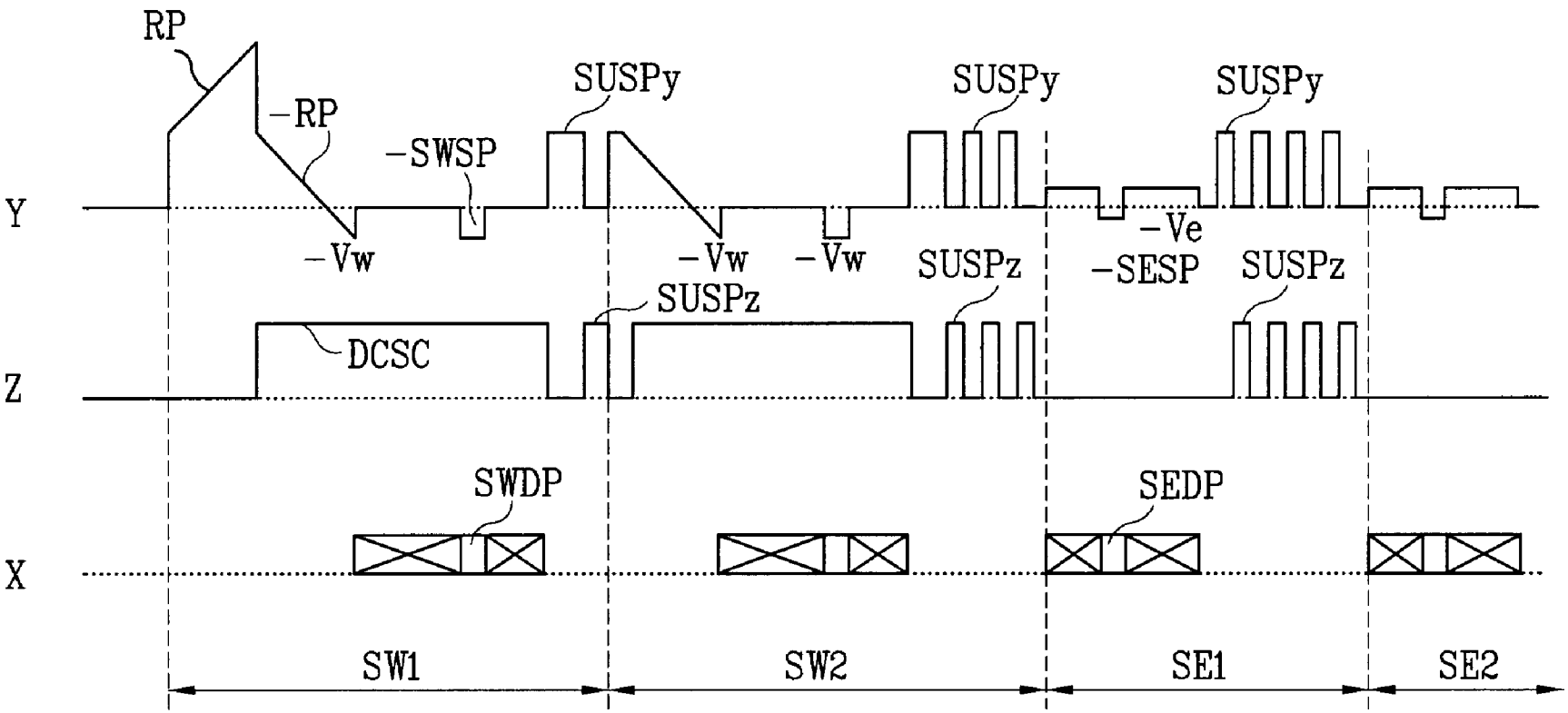
FIG.4 Related Art
FIG. 4 is a waveform diagram illustrating an example of driving waveforms according to the PDP driving in the frame of FIG. 3.
Figure 5A:
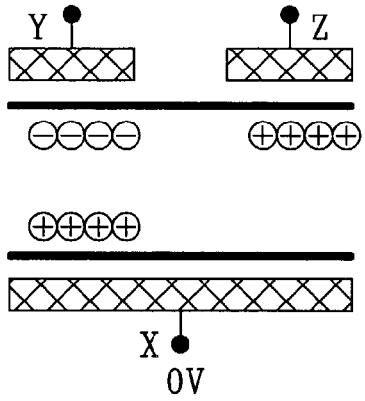
FIG.5A Related Art
FIGS. 5A to 5C are views illustrating the wall charges formed in a reset period of a selective write sub-field of FIG. 4.
Figure 5B:
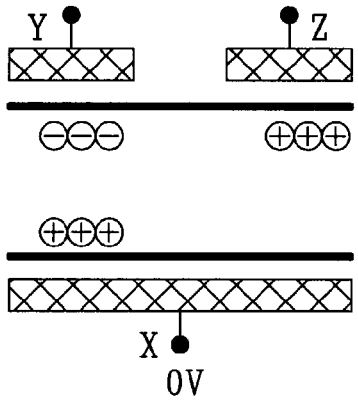
FIG.5B Related Art
Figure 5C:
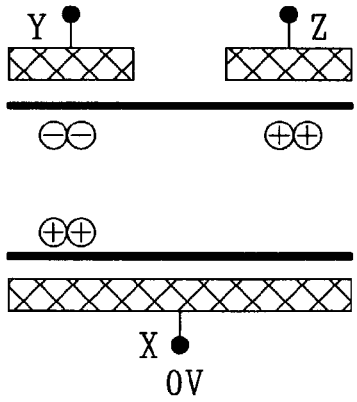
FIG.5C Related Art
Figure 6:
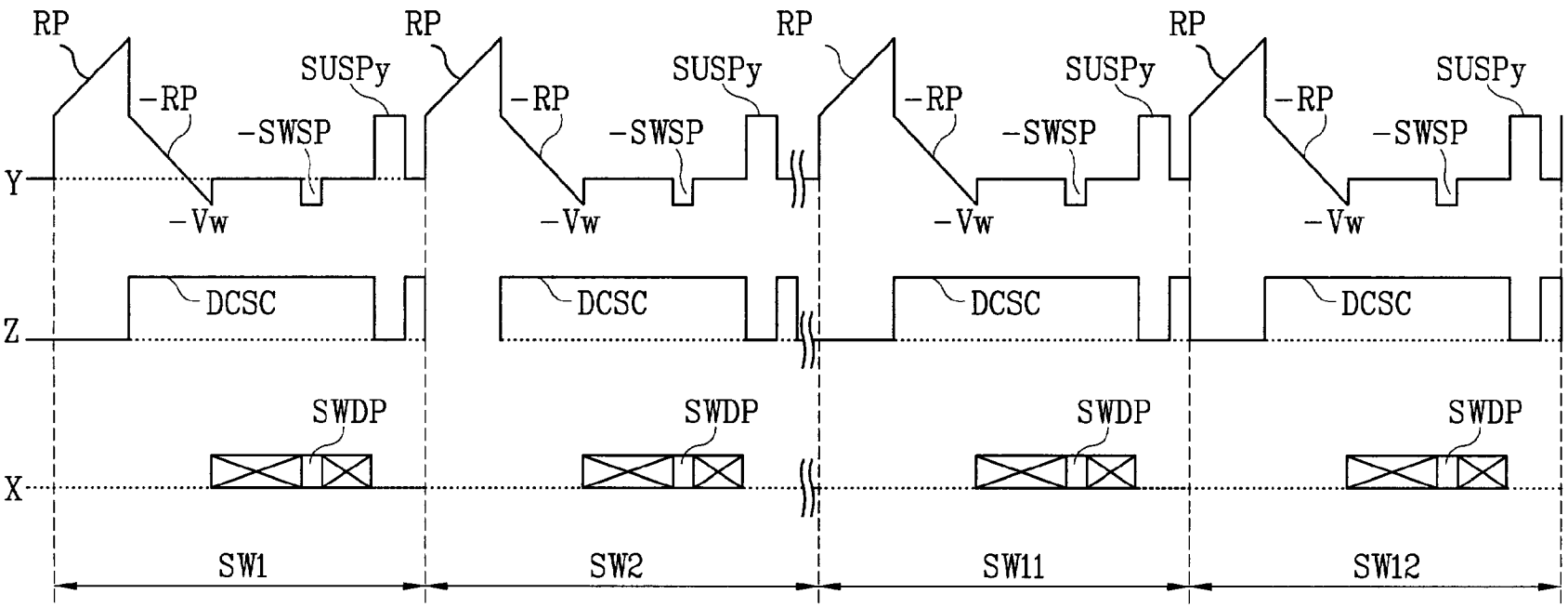
FIG.6 Related Art
FIG. 6 is a waveform diagram illustrating another example of driving waveforms according to the PDP driving in the frame of FIG. 3.
Figure 7:
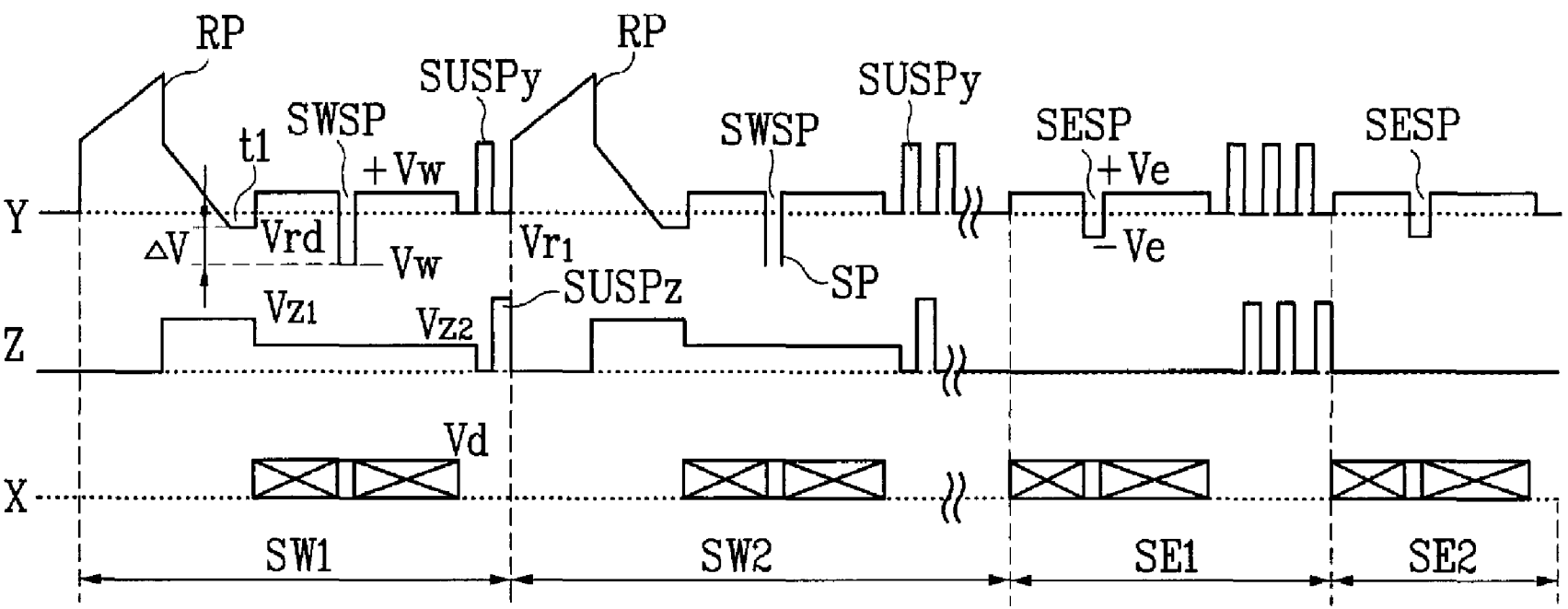
FIG. 7 is a waveform diagram illustrating driving waveforms for the PDP driving according to a first embodiment of the present invention.

FIG. 7 is a waveform diagram illustrating driving waveforms for the PDP driving according to a first embodiment of the present invention.

Referring to FIG. 7, for a reset period of a first selective write sub-field SW1, a reset pulse RP of a ramp-up waveform is supplied to the scan electrode lines Y in a set-up period, and then a reset pulse −RP of a ramp-down waveform is supplied to the scan electrode lines Y in a set-down period.

The reset pulse −RP of the ramp-down waveform does not descend to a negative (−) scan reference voltage −Vw, but descends to a reset down voltage Vrd whose level is relatively higher than the scan reference voltage −Vw.

The reset down voltage Vrd of the ramp-down waveform is kept for a specified period ti after it descends to the reset down voltage Vrd. Specifically, the reset down voltage Vrd is kept till the time point when the set-down period terminates. Here, the set-down period is determined to be the same time as in the conventional apparatus.

Thereafter, the supplied voltage of the scan pulse is kept in a level between the positive (+) scan reference voltage Vw and the negative (−) scan reference voltage −Vw. That is, the positive (+) voltage level of the scan pulse is set to be higher than the ground level, and the negative (−) voltage level of the scan pulse is set to be lower than the ground level. This voltage characteristic of the scan pulse is applied to the selective write sub-field SWs in the same manner.

In practice, the positive scan reference voltage Vw is set to 30V, and the negative scan reference voltage −Vw is set to about −80V. Also, the reset down voltage Vrd that is kept for the specified period t1 after the reset pulse −RP of the ramp-down waveform descends is set to −60~−65V that is about 15~20V higher than the negative scan reference voltage −Vw.

At the time point when the reset pulse −RP of the ramp-down waveform is supplied, a positive (+) scan DC voltage starts to be supplied to the sustain electrode lines Z. The positive (+) scan DC voltage is supplied till the address period for the reduction of the wall charge. That is, while the reset pulse −RP of the ramp-down waveform is supplied to the scan electrode lines Y in the reset period, a positive (+) first scan DC voltage DCSC1 is supplied, and while the selective write scan pulse SWSP is supplied in the above-described address period, a second scan DC voltage DCSC2 having a voltage level different from the first scan DC voltage DCSC1.

Specifically, while the reset pulse −RP of the ramp-down waveform is supplied to the scan electrode lines Y, the first scan DC voltage DCSC1 of 180V is supplied to the sustain electrode lines Z, and while the selective write scan pulse SWSP is supplied to the scan electrode lines Y, the second scan DC voltage DCSC2 of 150V is supplied to the sustain electrode lines Z.

Here, the second scan DC voltage DCSC2 applied to the sustain electrode lines Z in the address period becomes lower than the first scan DC voltage DCSC1 due to the reset down voltage Vrd supplied to the scan electrode lines Y in the reset period.

For the address period of the first selective write sub-field SW1, a selective write scan pulse SWSP is supplied to the scan electrode lines Y while the positive (+) second scan DC voltage DCSC2 is supplied to the sustain electrode lines Z, and a positive (+) selective write data pulse SWDP that is synchronized with the selective write scan pulse SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the first selective write sub-field SW1.

Also, at the end time point of a second selective write sub-field SW2, an erase pulse EP for erasing the sustain discharge is supplied to the scan electrode lines Y.

The reset period of the next selective erase sub-fields SE1,SE2, . . . is omitted as described above, and the address period starts directly.

For the address period of the selective erase sub-fields SE1;SE2, . . . , selective erase pulses SESP and SEDP for turning off the discharge cells are supplied to the scan electrode lines Y and the address electrode lines X, respectively. In more detail, the selective erase scan pulse SESP is supplied to the scan electrode lines Y, and the positive (+) selective erase data pulse SEDP that is synchronized with the selective erase scan pulse SESP is supplied to the address electrode lines X.

Here, the selective erase scan pulse SESP is supplied, descending from the positive (+) selective erase scan voltage level +Ve to the negative (−) selective erase scan voltage level −Ve that is higher than the scan reference voltage level −Vw. At this time, the positive selective erase scan voltage +Ve is set to about +40V, and the negative selective erase scan voltage −Ve is set to about −40V.

For the sustain period of the next selective erase sub-fields SE1,SE2, . . . , the sustain pulses (i.e., pulses having the same voltage level as the sustain pulses SUSPy and SUSPz of the selective write sub-field) are alternately supplied to the scan electrode lines Y and the sustain electrode lines Z so that the sustain discharge is produced with respect to the discharge cells which are not turned off by the address discharge.

In case that the following sub-field is the selective erase field SE, the sustain pulse SUSPy having a relatively large pulse width is supplied to the scan electrode lines Y at the end time point of the present selective erase sub-field SE.

In the last selective erase sub-field, an erase pulse EP and a ramp pulse are supplied to the scan electrode lines Y and the sustain electrode lines Z. Accordingly, the sustain discharge of the discharge cells of the turned-on state is erased. At this time, the next sub-field of the last selective erase sub-field will be the selective write sub-field SW.

Figure 8:
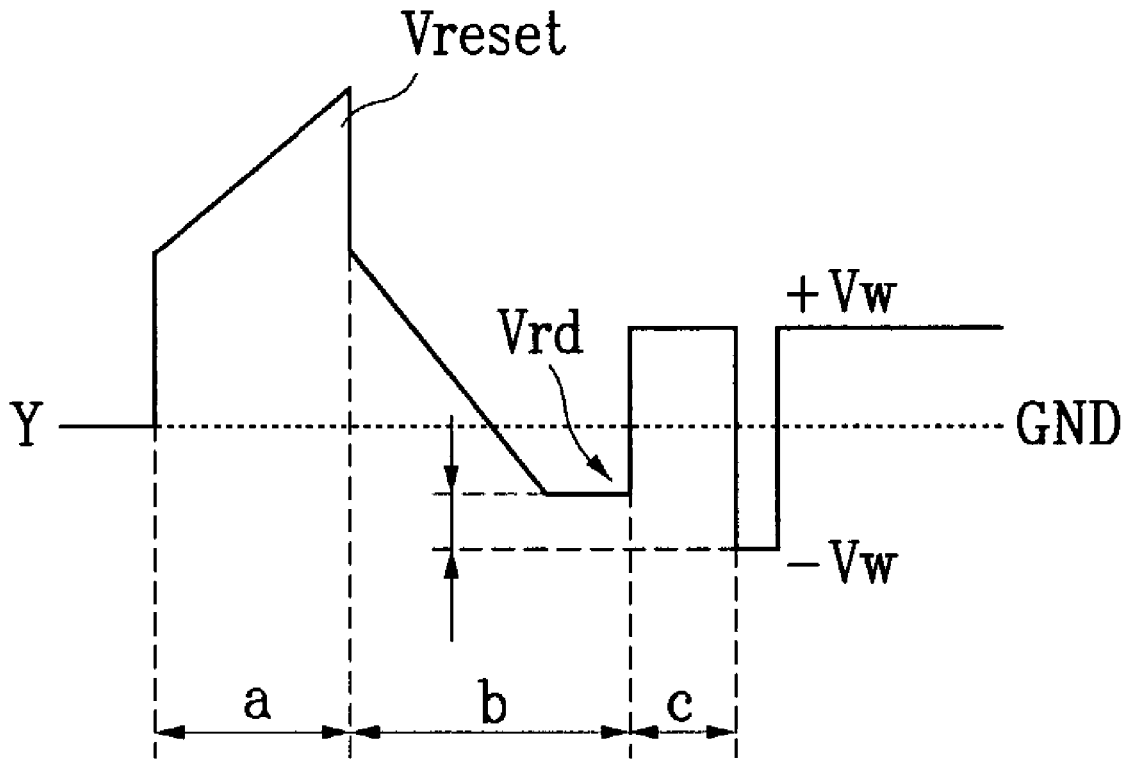
FIG. 8 is a waveform diagram illustrating driving waveforms applied in a reset period in selective write fields according to the PDP driving of FIG. 7.

FIG. 8 is a waveform diagram illustrating driving waveforms applied in a reset period in selective write fields according to the PDP driving of FIG. 7, and FIGS. 9A to 9C are views illustrating the wall charges formed in a reset period of FIG. 8.

Figure 9A:
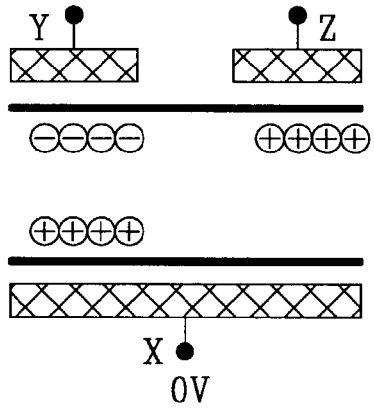
FIGS. 9A to 9C are views illustrating the wall charges formed in a reset period of FIG. 8.

Referring to FIGS. 8 and 9A to 9C, the wall charge illustrated in FIG. 9A is caused by the ramp-up waveform applied in the "a" period of FIG. 8. If the reset pulse of the ramp-up waveform is applied in the reset period of the selective write sub-field SW, the wall charge is produced on the scan electrode lines Y, the sustain electrode lines Z, and the address electrode lines of the whole panel as shown in FIG. 9A. At this time, the reset voltage Vreset of the applied reset pulse is a high voltage enough to turn on the panel without the data driving voltage (i.e., voltage of the data pulse).

The reason why such a high reset voltage Vreset is applied is to produce the wall charge in all the discharge cells, and thus the discharge cells having the most wall charges are provided except for the state that the cells of the whole panel are completely uniform.

Figure 9B:
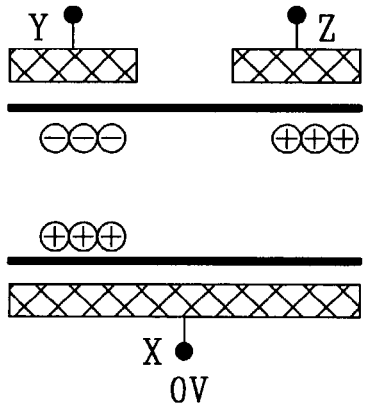

The wall charge illustrated in FIG. 9B is caused by the ramp-down waveform applied in the "b" period of FIG. 8. In the "b" period, the excessively formed wall charges are reduced.

Especially, in the "b" period, the reset pulse −RP of the ramp-down waveform does not descend to the negative (−) scan reference voltage −Vw, but descends to the reset down voltage Vrd whose level is relatively higher than the scan reference voltage −Vw of the "c" period, and then the reset pulse is kept till the time point when the set-down period is terminated. According to the characteristic of the ramp-down waveform of the "b" period, the reduced amount of wall charge of the respective electrode lines that is excessively accumulated due to the ramp-up waveform in the "a" period becomes smaller than that according to the conventional method.

Also, because of the higher wall charge caused by the characteristic of the ramp-down waveform in the "b" period, the data driving voltage (i.e., voltage level of the data pulse) applied to the address electrode lines X in the address period can be finally lowered. That is, according to the present invention, the data driving voltage can be lowered to about 35V by keeping the reset pulse −RP of the ramp-down waveform in the level of the reset down voltage Vrd.

Figure 9C:
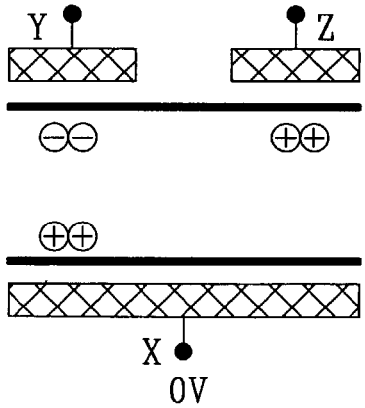

At this time, the wall charge produced on the respective electrode lines in the address period is shown in FIG. 9C.

Figure 10:
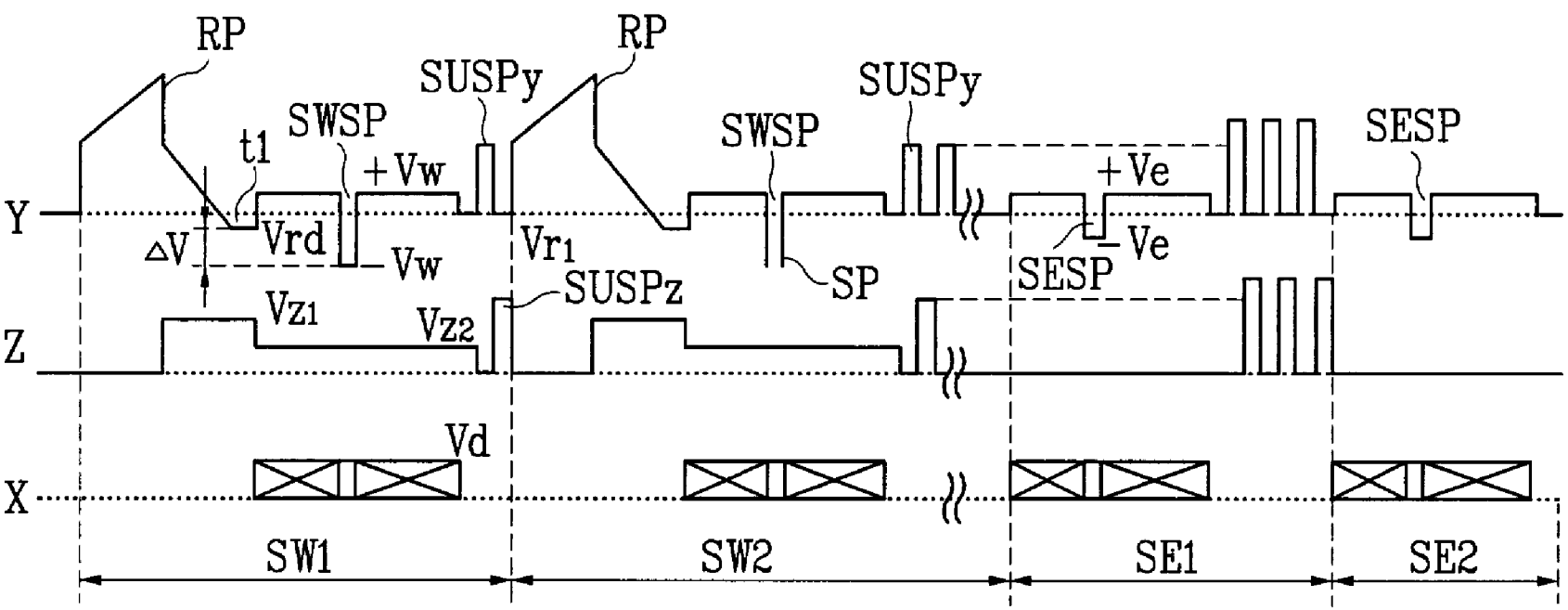
FIG. 10 is a waveform diagram illustrating driving waveforms for the PDP driving according to a second embodiment of the present invention.

FIG. 10 is a waveform diagram illustrating driving waveforms for the PDP driving according to a second embodiment of the present invention.

In FIG. 7, the voltage levels of the sustain pulses SUSPy and SUSPz of the selective erase sub-field SE are set to be the same as the voltage levels of the sustain pulses SUSPy and SUSPz of the selective write sub-field SW. On the contrary, in FIG. 10, the voltage levels of the sustain pulses SUSPy and SUSPz of the selective erase sub-field SE are set to be different from the voltage levels of the sustain pulses SUSPy and SUSPz of the selective write sub-field SW.

Referring to FIG. 10, for a reset period of a selective write sub-field SW, a reset pulse RP of a ramp-up waveform is supplied to the scan electrode lines Y in a set-up period, and then a reset pulse −RP of a ramp-down waveform is supplied to the scan electrode lines Y in a set-down period.

The reset pulse −RP of the ramp-down waveform descends to a reset down voltage Vrd whose level is relatively higher than the scan reference voltage −Vw, and then the reset down voltage level Vrd is kept till the scan pulse is supplied in the address period.

Thereafter, the voltage of the scan pulse is kept in a level between the positive (+) scan reference voltage Vw and the negative (−) scan reference voltage −Vw. That is, the positive (+) voltage level of the scan pulse is set to be higher than the ground level, and the negative (−) voltage level of the scan pulse is set to be lower than the ground level. This voltage characteristic of the scan pulse is applied to the selective write sub-field SWs in the same manner.

In practice, the positive scan reference voltage Vw is set to 30V, and the negative scan reference voltage −Vw is set to about −80V. Also, the reset down voltage Vrd that is kept for the specified period t1 after the reset pulse −RP of the ramp-down waveform descends is set to −60~−65V that is about 15~20V higher than the negative scan reference voltage −Vw.

At the time point when the reset pulse −RP of the ramp-down waveform is supplied, a positive (+) scan DC voltage starts to be supplied to the sustain electrode lines Z. The positive (+) scan DC voltage is supplied till the address period. That is, while the reset pulse −RP of the ramp-down waveform is supplied to the scan electrode lines Y, a first scan DC voltage DCSC1 of 180V is supplied to the sustain electrode lines Z, and while the selective write scan pulse SWSP is supplied to the scan electrode lines Y, a second scan DC voltage DCSC2 of 150V is supplied to the sustain electrode lines Z.

Here, the second scan DC voltage DCSC2 applied to the sustain electrode lines Z in the address period becomes lower than the first scan DC voltage DCSC1 due to the reset down voltage Vrd supplied to the scan electrode lines Y in the reset period.

For the address period of the selective write sub-field SW, a selective write scan pulse SWSP is supplied to the scan electrode lines Y while the positive (+) second scan DC voltage DCSC2 is supplied to the sustain electrode lines Z, and a positive (+) selective write data pulse SWDP that is synchronized with the selective write scan pulse SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the selective write sub-field SW.

Also, at the end time point of the last selective write sub-field SW, an erase pulse EP for erasing the sustain discharge is supplied to the scan electrode lines Y.

The reset period of the next selective erase sub-fields SE1,SE2, . . . is omitted as described above, and the address period starts directly.

For the address period of the selective erase sub-fields SE1,SE2, . . . , selective erase pulses SESP and SEDP for turning off the discharge cells are supplied to the scan electrode lines Y and the address electrode lines X, respectively. In more detail, the selective erase scan pulse SESP is supplied to the scan electrode lines Y, and the positive (+) selective erase data pulse SEDP synchronized with the selective erase scan pulse SESP is supplied to the address electrode lines X.

Here, the selective erase scan pulse SESP is supplied, descending from the positive (+) selective erase scan voltage level +Ve to the negative (−) selective erase scan voltage level −Ve that is higher than the scan reference voltage level −Vw. At this time, the positive selective erase scan voltage +Ve is set to about +40V, and the negative selective erase scan voltage −Ve is set to about −40V.

For the sustain period of the next selective erase sub-fields SE1,SE2, . . . , the sustain pulses SUSPy and SUSPz are alternately supplied to the scan electrode lines Y and the sustain electrode lines Z so that the sustain discharge is produced with respect to the discharge cells which are not turned off by the address discharge.

The voltage levels of the sustain pulses SUSPy and SUSPz for producing the sustain discharge in the selective erase sub-field SE are set to be higher than the voltage levels of the sustain pulses SUSPy and SUSPz for producing the sustain discharge in the selective write sub-field SW. In the actual driving, the voltage levels of the sustain pulses SUSPy and SUSPz in the selective erase sub-field SE are set to be about 35V higher than the voltage levels of the sustain pulses SUSPy and SUSPz in the selective write sub-field SW.

The voltages of the sustain pulses used in the selective write sub-field SW are optimally determined according to the positive (+) scan reference voltage +Vw, the negative (−) scan reference voltage −Vw, and the reset down voltage Vrd that is the voltage between the two scan reference voltages +Vw and −VW.

However, there is no separate driving of the reset period in the selective erase sub-field SE, and if the voltages of the sustain pulses used in the selective erase sub-field SE is set to the same level as the voltages of the sustain pulses used in the selective write sub-field SW, the voltage gain of the sustain pulses becomes lowered according to the different addressing conditions of the write sub-field and the erase sub-field. This may exert a bad influence upon the display state of the panel.

Consequently, in the embodiment of the present invention as shown in FIG. 10, a stable voltage gain is secured in both the selective write sub-field SW and the selective erase sub-field SE by using the sustain pulse voltages that match the addressing condition of the erase sub-field in the sustain period of the selective erase sub-field.

In case that the following sub-field is the selective erase field SE when the sustain pulses SUSPy and SUSPz are alternately supplied to the scan electrode lines Y and the sustain electrode lines Z in the sustain period of the next selective erase sub-fields SE1,SE2, . . . , the sustain pulse SUSPy having a relatively large pulse width is supplied to the scan electrode lines Y at the end time point of the present selective erase sub-field SE.

In the last selective erase sub-field, an erase pulse EP and a ramp pulse are supplied to the scan electrode lines Y and the sustain electrode lines Z. Accordingly, the sustain discharge of the discharge cells of the turned-on state is erased. At this time, the next sub-field of the last selective erase sub-field will be the selective write sub-field SW.

Figure 11:
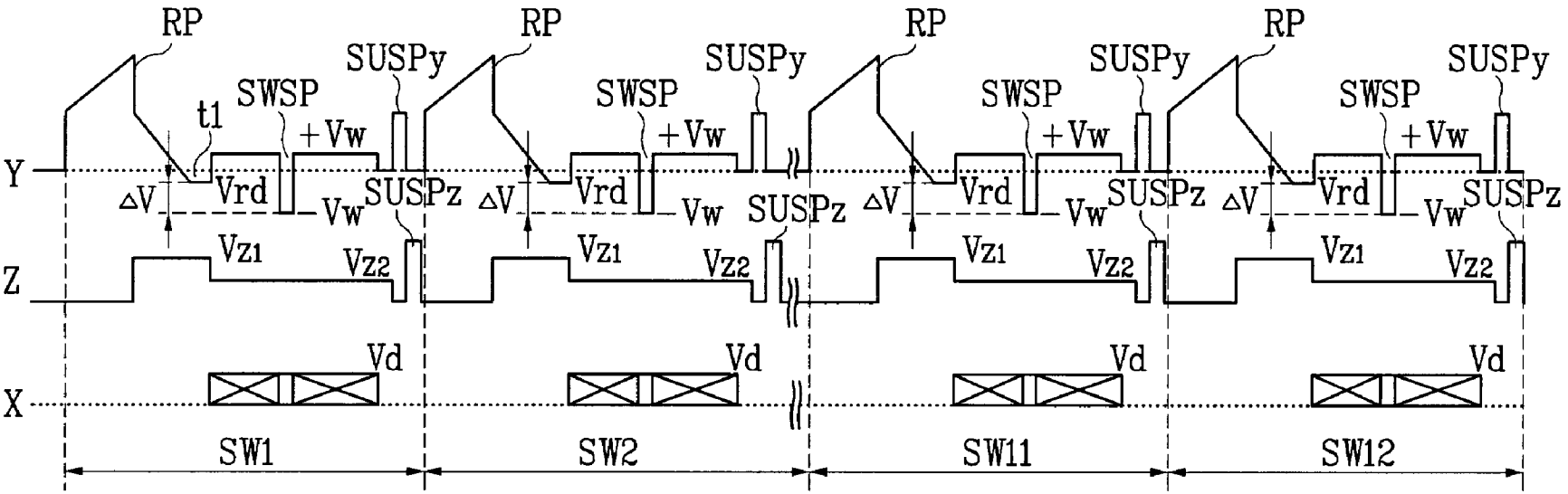
FIG. 11 is a waveform diagram illustrating driving waveforms for the PDP driving according to a third embodiment of the present invention.

FIG. 11 is a waveform diagram illustrating driving waveforms for the PDP driving according to a third embodiment of the present invention.

Referring to FIG. 11, a frame according to the driving of the AC surface discharge type PDP having three electrodes according to the present invention is divided into 12 sub-fields in time, and the divided sub-fields are all the selective write type sub-fields SW1 to SW12.

Also, the reset period and the address period in the respective selective write sub-fields SW are driven in the same manner as the reset period and the address period explained in FIG. 7.

Referring to FIG. 11, for a reset period of all selective write sub-fields SW, a reset pulse RP of a ramp-up waveform is supplied to the scan electrode lines Y in a set-up period, and then a reset pulse −RP of a ramp-down waveform is supplied to the scan electrode lines Y in a set-down period.

Especially, in the respective selective write sub-fields, the reset pulse −RP of the ramp-down waveform descends to a reset down voltage Vrd whose level is relatively higher than the scan reference voltage −Vw, and then the reset down voltage level Vrd is kept till the scan pulse is supplied in the address period.

Thereafter, the voltage of the scan pulse in the address period in all the selective write sub-fields is kept in a level between the positive (+) scan reference voltage Vw and the negative (−) scan reference voltage −Vw. That is, the positive (+) voltage level of the scan pulse is set to be higher than the ground level, and the negative (−) voltage level of the scan pulse is set to be lower than the ground level.

In practice, the positive scan reference voltage Vw is set to 30V, and the negative scan reference voltage −Vw is set to about −80V. Also, the reset down voltage Vrd that is kept for the specified period after the reset pulse −RP of the ramp-down specified period after the reset pulse −RP of the ramp-down waveform descends is set to −60~−65V.

At the time point when the reset pulse −RP of the ramp-down waveform is supplied, a positive (+) scan DC voltage starts to be supplied to the sustain electrode lines Z, and then is supplied till the address period.

That is, while the reset pulse −RP of the ramp-down waveform is supplied to the scan electrode lines Y, a first scan DC voltage DCSC1 of 180V is supplied to the sustain electrode lines Z, and while the selective write scan pulse SWSP is supplied to the scan electrode lines Y, a second scan DC voltage DCSC2 of 150V is supplied to the sustain electrode lines Z.

Here, the second scan DC voltage DCSC2 applied to the sustain electrode lines Z in the address period becomes lower than the first scan DC voltage DCSC1. This is due to the characteristic of the ramp-down waveform of the reset down voltage Vrd supplied to the scan electrode lines Y in the reset period.

For the address period of the selective write sub-fields SW1 to SW12, a selective write scan pulse SWSP is supplied to the scan electrode lines Y while the positive (+) second scan DC voltage DCSC2 is supplied to the sustain electrode lines Z, and a positive (+) selective write data pulse SWDP that is synchronized with the selective write scan pulse SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the selective write sub-field SW.

As shown in FIG. 11, the driving of the whole panel is stabilized by using the ramp-down waveform having the characteristic that the reset down voltage Vrd, which descends from the positive (+) scan reference voltage +Vw and is higher than the negative (−) scan reference voltage −Vw, is kept for the specified time in the reset period of all the sub-fields.

Especially, in the reset period of all the sub-fields, the data driving voltage (i.e., voltage level of the data pulse) applied in the address period can be lowered by setting a threshold value, to which the voltage level of the ramp-down waveform descends, to the voltage Vrd that is higher than the negative (−) scan reference voltage −Vw.

Figure 12:
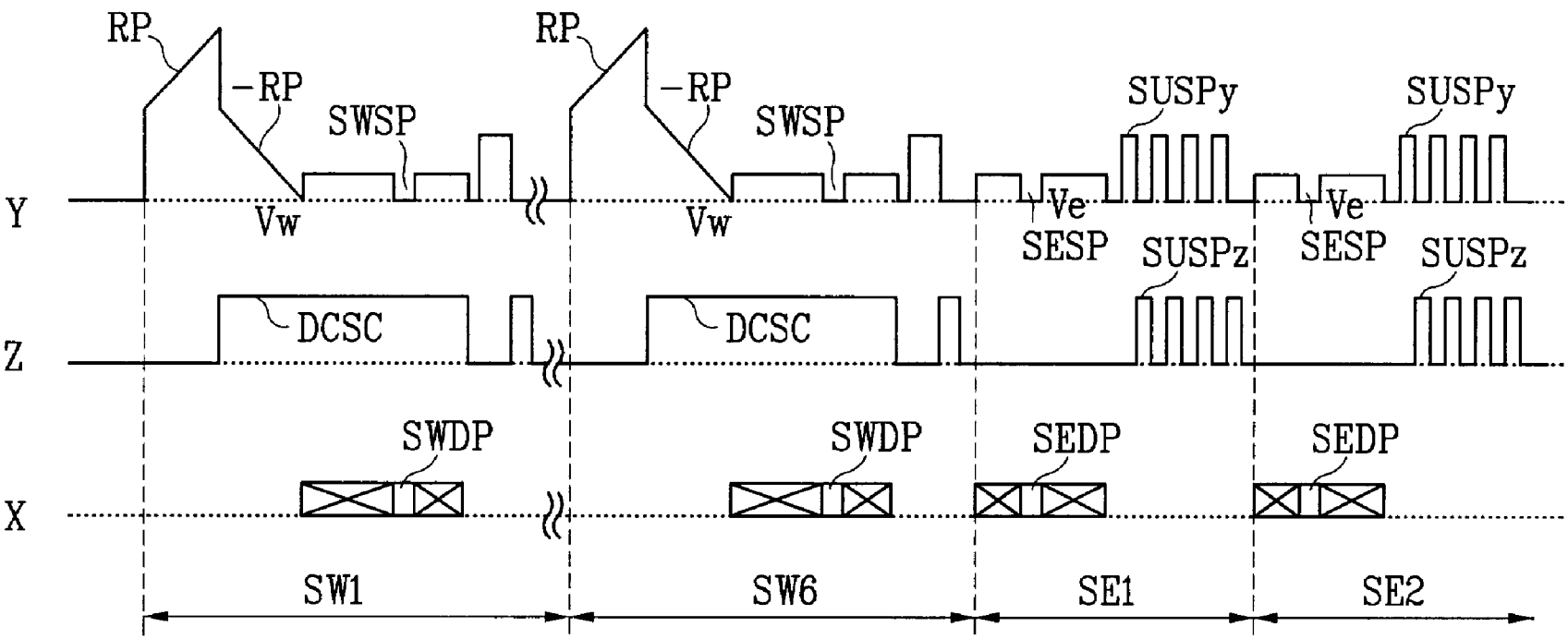
FIG. 12 is a waveform diagram illustrating driving waveforms for the PDP driving according to a fourth embodiment of the present invention.

FIG. 12 is a waveform diagram illustrating driving waveforms for the PDP driving according to a fourth embodiment of the present invention.

Referring to FIG. 12, a frame according to the driving of the AC surface discharge type PDP having three electrodes according to the present invention is divided into 12 sub-fields in time. Specifically, the one-frame period in the respective discharge cells is divided into selective write type sub-fields SW1 to SW6 and selective erase type sub-fields SE1 to SE12.

For a reset period of the selective write sub-field SW, a reset pulse RP of a ramp-up waveform is supplied to the scan electrode lines Y in a set-up period, and then a reset pulse −RP of a ramp-down waveform is supplied to the scan electrode lines Y in a set-down period.

At this time, the reset pulse −PR of the ramp-down waveform descends to the ground level (0V), not to the negative (−) scan reference voltage −Vw. Also, at the time point when the reset pulse −RP of the ramp-down is supplied, the positive (+) scan DC voltage DCSC starts to be supplied to the sustain electrode lines Z.

For the address period of the selective write sub-field SW, a positive (+) selective write scan pulse SWSP is supplied to the scan electrode lines Y while the positive (+) scan DC voltage DCSC is supplied to the sustain electrode lines Z, and a positive (+) selective write data pulse SWDP that is synchronized with the selective write scan pulse SWSP is supplied to the address electrode lines X.

In order to produce the sustain discharge with respect to the discharge cells selected by the address discharge, sustain pulses SUSPy and SUSPz are alternately supplied to the scan electrode lines Y and the sustain electrode lines Z during the sustain period of the selective write sub-field SW.

Also, at the end time point of the last selective write sub-field SW, an erase pulse EP for erasing the sustain discharge is supplied to the scan electrode lines Y.

According to the panel driving of FIG. 12 according to the present invention, since the reset pulse −RP of the ramp-soen waveform does not descend to the negative (−) scan reference voltage −Vw, and the positive (+) selective write scan pulse SWSP is supplied in the address period, the positive (+) selective write data pulse SWDP applied in synchronization with the selective write scan pulse SWSP can be kept in a lower voltage level. That is, the data driving voltage (i.e., voltage level of the data pulse) is further lowered.

The reset period of the next selective erase sub-fields SE1,SE2, . . . is omitted as described above, and the address period starts directly.

For the address period of the selective erase sub-fields SE1,SE2, . . . , selective erase pulses SESP and SEDP for turning off the discharge cells are supplied to the scan electrode lines Y and the address electrode lines X, respectively. In more detail, the positive (+) selective erase scan pulse SESP is supplied to the scan electrode lines Y, and the positive (+) selective erase data pulse SEDP synchronized with the selective erase scan pulse SESP is supplied to the address electrode lines X.

Here, the selective erase scan pulse SESP is supplied, descending from the positive (+) selective erase scan voltage level +Ve to the ground level (0V).

For the sustain period of the next selective erase sub-fields SE1,SE2, . . . , the sustain pulses (i.e., pulses that have the voltage levels equal to the sustain pulses SUSPy and SUSPz of the selective write sub-fields, respectively) are alternately supplied to the scan electrode lines Y and the sustain electrode lines Z so that the sustain discharge is produced with respect to the discharge cells which are not turned off by the address discharge.

Meanwhile, if the following sub-field is the selective sub-field SE, a sustain pulse having a relatively large pulse width is supplied to the scan electrode lines Y at the end time period of the selective erase sub-field SE.

In the last selective erase sub-field, an erase pulse and a ramp pulse are supplied to the scan electrode lines Y and the sustain electrode lines Z. Accordingly, the sustain discharge of the discharge cells of the turned-on state is erased. At this time, the next sub-field of the last selective erase sub-field will be the selective write sub field.

As described above, according to the PDP driving method according to the present invention, the data driving voltage (i.e., voltage level of the data pulse) applied in the address period can be lowered by supplying the reset pulse of the ramp-down waveform with a voltage higher than the negative (−) scan reference voltage −Vw without descending the reset pulse to the scan reference voltage −Vw and applying a scan voltage that is between the positive (+) scan voltage and the negative (−) scan voltage based on the ground level to the scan electrode lines Y in the reset period.

Especially, the data driving voltage that is the discharge start voltage of the address discharge is minimized, and thus the power consumption for the whole driving of the PDP can be reduced.

In the embodiment of the present invention, the sustain pulse voltage for the sustain discharge of the selective erase sub-field SE is set to be higher than the sustain pulse voltage of the selective write sub-field SW with respect to a frame of the respective discharge cell that is divided into selective write type sub-fields and selective erase type sub-fields, and this causes almost no loss of a voltage gain of the sustain pulse according to the different addressing condition. Consequently, the display state of the panel becomes more stable.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A three-electrode plasma display panel (PDP) driving method for displaying a frame including a plurality of sub-fields, the method comprising:

generating a reset discharge by supplying ramp waves for making cells of the PDP in a uniform state in a reset period of selective write type sub-fields;

generating an address discharge by supplying a selective write scan pulse (SWSP) that swings round a maximum supply voltage level of the reset discharge and a selective write data pulse (SWDP) that is synchronized with the selective write scan pulse (SWSP) during an address period following the reset period; and keeping the generated address discharge by supplying a sustain pulse during a sustain period following the address period, wherein generating a reset discharge comprises:

adding up a reset pulse of a ramp-up waveform;

supplying the reset pulse to a scan electrode;

supplying to the scan electrode a reset pulse of a ramp-down waveform; and maintaining a minimum supply voltage level based on the ramp-down waveform for a specified period, wherein the specific period is determined based on the reset pulse of the ramp-up waveform going from a maximum voltage level down to the minimum supply voltage level, and wherein the minimum supply voltage level is relatively higher than a predetermined negative scan reference voltage;

supplying a positive scan DC voltage for reducing wall charge previously formed, when the reset pulse of the ramp-down waveform is supplied; and supplying a second scan DC voltage relatively lower than the first scan DC voltage to sustain the voltage so as to minimize power consumption in the plasma display panel.

2. The method as claimed in claim 1, wherein the reset pulse of the ramp-up waveform is added up to 30V at maximum, and the reset pulse of the ramp-down waveform goes down to the voltage level that is 15~20V higher than the negative scan reference voltage determined as −80V.

3. The method as claimed in claim 1, wherein the second scan DC voltage is relatively lower than the first scan DC voltage.

4. The method as claimed in claim 1, wherein the first scan DC voltage is of 180V, and the second scan DC voltage is of 150V.

5. The method as claimed in claim 1, wherein at the second step, the selective write data pulse SWDP for producing the address discharge is of 35V.

6. The method as claimed in claim 1, further comprising a fourth step of generating an address discharge for turning off the discharge cells which were turned on in the selective write type sub-fields by supplying a selective erase scan pulse (SESP) to the scan electrode and supplying a positive (+) selective erase data pulse (SEDP) that is synchronized with the selective erase scan pulse (SESP) to an address electrode in the address period of the selective erase type sub-fields after the third step.

7. The method as claimed in claim 6, wherein the selective erase scan pulse (SESP) descends from a predetermined positive (+) selective erase scan voltage level to a negative selective erase scan voltage level that is higher than the predetermined negative (−) scan reference voltage.

8. The method as claimed in claim 7, wherein the selective erase scan pulse (SESP) descends from the predetermined positive (+) selective erase scan voltage level of about +40V to the negative selective erase scan voltage level of about −40V.

9. The method as claimed in claim 6, wherein the positive (+) selective erase data pulse (SEDP) is of about 35V.

10. The method as claimed in claim 6, further comprising a fifth step of generating a sustain discharge for the discharge cells which were not turned off by the address discharge by supplying the sustain pulse in the sustain period following the address period of the selective erase type sub-fields after the fourth step.

11. The method as claimed in claim 10, wherein at the fifth step, one or more sustain pulses are alternately supplied to the scan electrode and the sustain electrode.

12. The method as claimed in claim 10, wherein the voltage level of the sustain pulse of the selective erase type sub-field is equal to that of the sustain pulse provided from the selective write type sub-field.

13. The method as claimed in claim 10, wherein the voltage level of the sustain pulse of the selective erase type sub-field is relatively higher than that of the sustain pulse provided from the selective write type sub-field.

14. The method as claimed in claim 10, wherein the voltage level of the sustain pulse of the selective erase type sub-field is about 35V higher than that of the sustain pulse provided from the selective write type sub-field.

15. The method as claimed in claim 1, wherein the frame is divided into the selective write type sub-fields in all.

16. A three-electrode plasma display panel (PDP) driving method for displaying a frame including at least one selective write type subfield that represents a low gray scale by turning on selected discharge cells and keeping discharge of the discharge cells, and at least one selective erase type sub-field that represents a high gray scale by turning off the cells turned on in the last subfield among the selective write type sub-fields, the method comprising;

generating a reset discharge by supplying positive ramp waves for making the cells of the PDP in a uniform state in a reset period of selective write type sub-fields;

generating an address discharge by supplying a selective write scan pulse (SWSP) that swings over a ground voltage level and a positive selective write data pulse (SWDP) that is synchronized with the selective write scan pulse (SWSP) during an address period following the reset period; and keeping the generated address discharge by supplying a sustain pulse during a sustain period following the address period, wherein generating a reset discharge comprises, a rest pulse of a ramp-up waveform that is added up is supplied to a scan electrode, and then to the scan electrode is supplied a reset pulse of a ramp-down waveform that goes from a maximum voltage level of the ramp-up waveform down to at least the ground voltage level so as to minimize power consumption in the plasma display panel, and maintaining a minimum supply voltage level based on the ramp-down waveform for a specified period, wherein the specified period is determined based on the reset pulse of the ramp-up waveform going from a maximum voltage level down to the minimum supply voltage level.

17. The method as claimed in claim 16, wherein from a time point when the reset pulse of the ramp-down waveform is supplied to the address period, a positive (+) scan DC voltage for reducing wall charge previously formed is supplied to a sustain electrode.

18. The method as claimed in claim 16, further comprising a fourth step of generating an address discharge for turning off the discharge cells which were turned on in the selective write type sub-fields by supplying a selective erase scan pulse (SESP) to the scan electrode and supplying a positive (+) selective erase data pulse (SEDP) that is synchronized with the selective erase scan pulse (SESP) to an address electrode in the address period of the selective erase type sub-fields after the third step.

19. The method as claimed in claim 18, wherein the selective erase scan pulse (SESP) descends from a predetermined selective erase scan voltage level to the ground level or more.

20. The method as claimed in claim 18, further comprising a fifth step of generating a sustain discharge for the discharge cells which were not turned off by the address discharge by alternately supplying the sustain pulses to the scan electrode and a sustain electrode in the sustain period following the address period of the selective erase type sub-fields.

21. The method as claimed in claim 20, wherein the voltage level of the sustain pulse of the selective erase type sub-field is equal to that of the sustain pulse provided from the selective write type sub-field.

22. The method as claimed in claim 20, wherein the voltage level of the sustain pulse of the selective erase type sub-field is relatively higher than that of the sustain pulse provided from the selective write type sub-field.

* * * * *